United States Patent [19]

Elliott et al.

[11] 4,111,608

[45] Sep. 5, 1978

[54] GAS LIFT SYSTEM

[75] Inventors: J. Kelly Elliott, Baytown; Douglas W. Crawford, Houston, both of Tex.

[73] Assignee: Schlumberger Technology Corporation, New York, N.Y.

[21] Appl. No.: 660,088

[22] Filed: Feb. 23, 1976

Related U.S. Application Data

[60] Continuation of Ser. No. 565,349, Apr. 7, 1975, abandoned, which is a continuation of Ser. No. 195,935, Nov. 5, 1971, abandoned, which is a division of Ser. No. 25,985, Apr. 6, 1970, Pat. No. 3,646,953.

[51] Int. Cl.[2] ..... F04F 1/20

[52] U.S. Cl. ..... 417/112; 417/115; 417/117

[58] Field of Search ..... 417/109, 112, 115, 117

[56] References Cited

U.S. PATENT DOCUMENTS

| | | | |
|---|---|---|---|
| 2,008,172 | 7/1935 | Bryant | 417/109 |
| 2,837,108 | 6/1958 | Howard | 137/155 |
| 3,192,869 | 7/1965 | McCarvell et al. | 417/115 |

*Primary Examiner*—Carlton R. Croyle

*Assistant Examiner*—R. E. Gluck

*Attorney, Agent, or Firm*—David L. Moseley; William R. Sherman; Edward M. Roney

[57] ABSTRACT

A casing pressured operated, variable orifice valve is employed as the operating valve in a single point injection well assembly with tubing pressure (fluid) operated unloading valves acting above the operating valve to provide a continuous flow system. The operating valve includes a throttling range which extends between optimum injection gas pressure levels based on the amount of injection gas pressure available at the well head to thereby increase the overall efficiency of the system. The variable orifice valve includes a pressure charged bellows and a coil spring in series to produce a linear resultant load rate which in turn cooperates with contoured closure surfaces in the valve to produce a linear relationship between orifice size and injection gas pressure. Gas is thus injected into the production column or tubing at a rate which is linearly related primarily to the casing pressure with the throttling range of the operating valve producing a broad response in the gas injection rate. The injection rate is surface regulated by controlling the injection gas pressure at the well head.

3 Claims, 7 Drawing Figures

GAS LIFT SYSTEM

This is a continuation, of application Ser. No. 565,349, filed Apr. 7, 1975, now abandoned, which was a Continuation of Application Ser. No. 195,935, filed Nov. 5, 1971, now abandoned which was a division of Application Ser. No. 25,985, filed Apr. 6, 1970, now U.S. Pat. No. 3,646,953.

BACKGROUND OF THE INVENTION

1. Field of the Invention

The present invention relates to apparatus for elevating fluids through a flow path. More specifically, the present invention relates to a system or apparatus for surface controlled gas lifting of petroleum fluids from a subterranean formation through a well conduit to the earth's surface.

2. Brief Description of the Prior Art

In conventional gas lift systems, petroleum fluids are artificially lifted to the surface of a well by injecting a gas under pressure into the column containing the fluid to be elevated. By this means, a desired flowing bottomhole pressure is created in the well which permits elevation of the petroleum fluids to the well head at a desired rate. In a typical continuous flow gas lift system, gas is introduced into the well casing and injected into the petroleum fluid column contained within the tubing string. The casing gas is injected into the tubing through a single gas lift valve referred to as the operating valve which is generally disposed in the tubing string below a series of vertically spaced unloading valves.

When tubing pressure operated (fluid operated) gas lift valves are employed to unload the well, each unloading valve closes automatically when the tubing pressure opposite the valve decreases below a predetermined minimum valve. By this means, each succeeding lower valve is closed as the fluid level in the annulus is successively lowered and the tubing fluid level is raised until the operating or bottommost injection valve is exposed to the injection gas in the casing. The latter valve, the operating valve, is thereafter employed as the single point injection valve for a continuous flow gas lift system. Where casing pressure operated rather than fluid operated valves are employed to unload, closure of each succeedingly lower casing pressure operated valve generally necessitates a succeeding reduction in the casing pressure. For this reason, a lower effective injection gas pressure is available for injection into the tubing at the operating valve as compared with that available with the use of fluid operated unloading valves.

In conventional systems, the regulation range, i.e., the injection gas pressure range over which the operating valve remains open, also presents problems in that the regulation range of a casing pressure operated valve is generally relatively limited resulting in little or no control over the rate of gas injection into the tubing. It is well known that as the well conditions change or as production rates are altered to conform to restrictions imposed by regulatory agencies, the most effective or efficient rate of gas injection may be different from that existing in the well at the beginning of the gas lift operation and it is often desirable to alter the injection rate with such changing conditions or restrictions. Where casing pressure operated unloading valves are used, raising the gas pressure in an attempt to increase the injection rate may only serve to move the point of gas injection up the well to a higher gas lift valve. This is usually undesirable since optimum producing conditions normally require injection at the lowermost valve possible, thus making it clear that the lifting efficiency is reduced whenever the point of injection moves above a specified injection point.

While controlled variation in the rate of introducing gas into the production fluid column is highly desirable, it will be understood that it is impractical to attempt to control the injection rate by replacing the operating valve each time a new injection rate is desired. In short, the prior art apparatus and methods available for gas lift operations have lacked suitable means for effecting surface controlled regulation of the rate at which gas is injected into the fluid column through the operating valve. Moreover, the conditions normally imposed by conventionally employed casing pressure operated unloading valves limit the operating range of prior art systems to pressure levels significantly below the injection gas pressure available at the well head.

SUMMARY OF THE INVENTION

In the system or apparatus of the present invention, a variable orifice, casing pressure operated valve is employed as the operating valve in a single point injection, continuous flow gas lift installation with regulation of the gas injection rate being controlled by varying the injection gas pressure at the well head. In the preferred form of the invention, fluid operated valves are employed above the operating valve to unload the well thereby permitting gas injection through the operating valve at the highest possible injection gas pressures based upon the gas pressure available at the well head.

Thus, in accordance with the principles the present invention, fluid operated unloading valves are employed whereby opening and closing of the unloading valves is regulated by the pressure of the production fluid in the tubing rather than the pressure of the injection gas in the casing. For this reason, the casing pressure at the well head may be maintained at the maximum desirable level while maintaining injection of gas into the fluid column through a single operating valve. The net result is that a substantially higher gas pressure is available at the operating valve for injection into the tubing which in turn increases the overall efficiency of the system.

The operating valve of the present invention includes a spring and a pressure charged bellows connected in series to form a resultant load rate which produces a linear relationship between valve stem travel and changes in casing pressure. The valve stem includes a contoured closing surface which is adapted to move toward and away from a valve seat under the influence of the injection gas pressure with the contour and load rate producing a linear relationship between the effective orifice size and the injection gas pressure. Operation of the variable orifice valve is controlled by varying the injection gas pressure at the well head which in turn alters the orifice size of the operating valve to change the rate of gas injection into the production fluid column. The design of the valve is effective to produce a throttling range in which large changes in the rate of gas injected into the production fluid column are possible with relatively small changes in the pressure of the injection gas. The linear relationship between orifice size and injection gas pressure provides a linear relationship between changes in the injection gas pressure effected at the surface and changes in the rate of gas injection into the fluid column.

Where casing pressure operated valves are employed as unloading valves, the highest maximum operating range for the variable orifice operating valve of the present invention is decreased, however, improved regulation and response is also possible when compared with that possible with fixed orifice valves operating over the same injection gas pressure range.

The foregoing and other features and advantages of the present invention will become more apparent from the following detailed description and claims when taken in conjunction with the accompanying drawings.

DESCRIPTION OF THE PREFERRED EMBODIMENT

Figure 1:
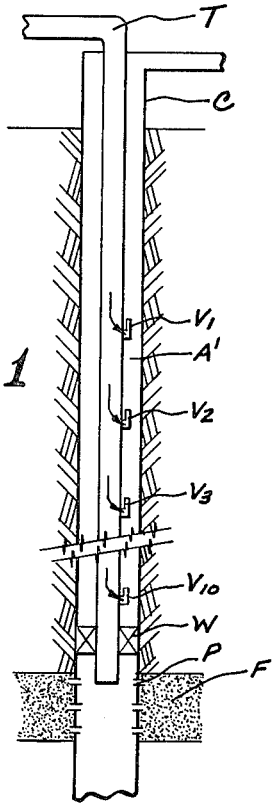
FIG. 1 is an elevation, partially in section schematically illustrating a gas lift installation.

FIG. 1 illustrates a representative gas lift installation which includes a casing C surrounding a production tubing string T. The casing C and tubing T extend downwardly into a petroleum bearing formation F. Perforations P formed in the casing C permit petroleum fluids in the formation to flow into the casing and into the open lower end of the production tubing string T. A suitable well packer W is employed to form a leakproof seal between the tubing T and the casing C to thereby isolate the annular area A from the formation.

Under many conditions, the natural pressure of the formation F is sufficient to produce flow of petroleum fluids through the perforations P and into the production tubing T where the fluid is forced up to the well head. In low pressure formations, however, the natural formation pressure is insufficient to elevate the production fluid through the tubing string T or, in some cases, the formation pressure is adequate to maintain a continuous flow of fluid through the tubing string, but is insufficient to initiate flow with the well fluids in static, non-flowing condition. Under any of the foregoing conditions, when the existing formation pressure is insufficient to produce or sustain natural flow of the production fluid at the well head, artificial means of lifting the production fluid, such as gas lift are required.

In the system illustrated in FIG. 1, a suitable gas under pressure is forced into the annular area A' (annulus) formed between the tubing T and the casing C where it then enters gas lift valves V ($V_1$, $V_2$, $V_3$–$V_{10}$) which transmit the gas from the casing C into the tubing string T to aerate or lighten the fluid contained in tubing string T. As the column is aerated by gas introduced through the valves V, the total weight of the column is reduced to the point required to permit the existing formation pressure to elevate the petroleum fluid to the surface.

Under certain conditions, maximum efficiency dictates that the gas be injected into the tubing string through only a single valve located as low as possible in the tubing string T. For this reason, the upper valves located above the lowermost operating valve must close after the well has been unloaded and remain closed while gas is injected through the operating valve. It will be understood that the term "unloading" as used herein refers to the initial operation of the gas lift installation which requires removal of fluids from the annular area A' to permit the pressurized gas to reach the various gas lift valves in the system. During the unloading, fluid in annulus A' above the packer W is forced into the tubing by the gas injected into the annulus which U-tubes the fluid into the unloading valves and into the tubing T.

In the preferred form of the present invention, the operating valve indicated generally at $V_{10}$ is casing pressure operated and the unloading valves $V_1$, $V_2$, and $V_3$ are tubing pressure operated (fluid operated). The construction and operation of fluid operated valves are well known in the industry. A fluid operated valve is one which is operable to admit gas into a tubing string when a predetermined head or pressure of the oil or other liquid develops in the tubing string. Examples of fluid operated valves are shown in the following U.S. Pat. Nos. 2,876,703-Carlisle et al; 3,011,511-Canalizo; and 3,192,869-McCarvell et al. The operating valve $V_{10}$ is a variable orifice, casing pressure operated valve which includes a throttling range wherein the valve remains open between two different injection gas pressure levels in the casing C. By the described means of the present invention, the pressure of the injection gas in the casing C may be varied to regulate the rate of gas injection into the tubing string T through the operating valve $V_{10}$. As will be seen, the specific design of the valve $V_{10}$ produces a linear relationship between injection gas pressure in the casing and the rate of gas injection into the tubing string T to produce a broad, linearly regulated response range.

Figure 2:
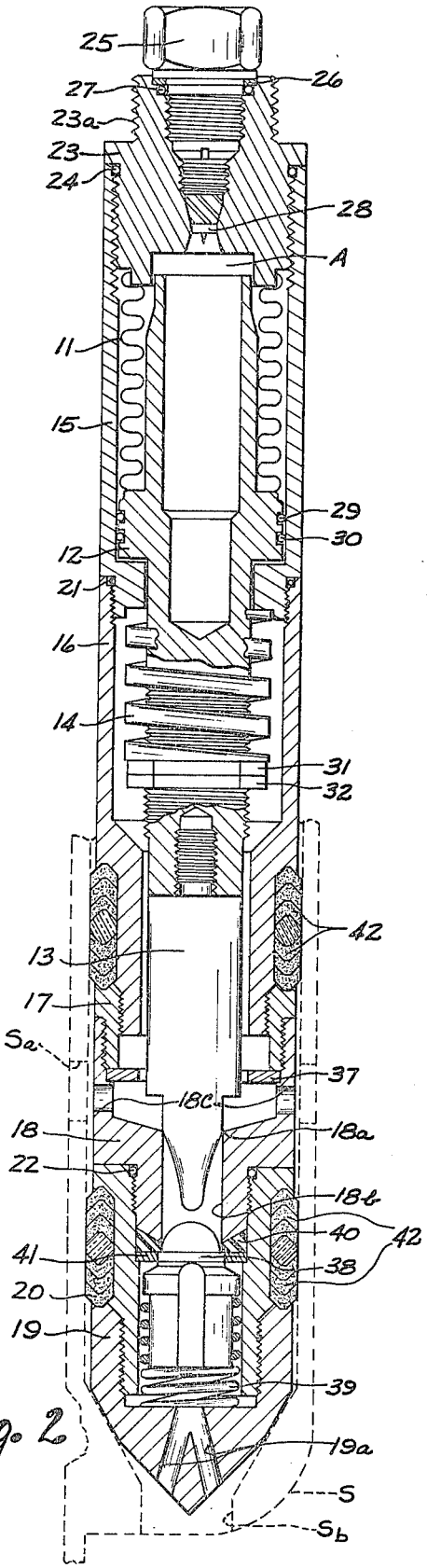
FIG. 2 is a vertical section of the variable orifice gas lift valve of the present invention.

Referring to FIG. 2, the valve $V_{10}$ of the present invention is illustrated mounted in operative position in a mandrel side pocket S partially drawn in by dotted lines. The valve $V_{10}$ includes a pressure charged bellows 11 secured to the upper portion of an axially movable lower adapter 12 which in turn is secured at its lower end to a valve stem 13. A helical coil spring 14 encircles the lower adapter 12 and acts in series with the bellows 11 to exert an axially directed force on the valve stem 13. The bellows 11 and spring 14 govern the "load rate" of the valve $V_{10}$ which is the relationship between injection gas pressure and stem travel.

The bellows 11, lower adapter 12, spring 14 and valve stem 13 are housed within a composite outer valve body which includes an upper housing body 15 threadedly engaged at its lower end to a lower housing body 16. A head adapter 17 secures the lower housing body 16 to a valve head 18 forming the lower part of the valve $V_{10}$. At the bottom of the valve, a tapered nose section 19 is threadedly engaged to check body housing 20 which in turn is threadedly engaged to the lower end of the valve head 18. The outer housing is sealed by means of resilient O-rings 21 and 22 positioned respectively between the upper and lower housing body sections 15 and 16 and the valve head 18 and check body 20.

The upper end of the gas lift valve $V_{10}$ is sealed by a retrievable bellows top 23 which is threadedly engaged into the top of the upper housing body 15. The external surface of the bellows top 23 is provided with threads 23*a* which are adapted to engage a suitable positioning or fishing tool (not shown) employed to position the valve $V_{10}$ within or retrieve it from the pocket S. A resilient O-ring 24 is disposed between the housing body 15 and the bellows top 23 to provide a leakproof seal between the two mated components. A seal plug 25 is threadedly engaged in the bellows top 23 and a seal plug gasket 26 and a resilient O-ring 27 are disposed between the seal plug and the bellows top 23 to seal the enclosed bellows area A. A dill core valve 28 is positioned within the central opening formed in the bellows top 23 to permit pressurization of the bellows chamber with nitrogen or other suitable gas from an external source.

A pair of drag rings 29 and 30 are positioned between the lower adapter 12 and the upper housing body 15 to form a guide between the adapter and the housing. As will be seen, gas pressure acts against the bellows to move the adapter 12 axially in a direction dependent upon the pressure differential existing between the injection gas and the internal bellows area A. It may also be seen that an axial force is imparted to the lower adapter 12 by the coil spring 14 which is compressed between the lower end of the upper housing member 15 and an axially movable adjustment nut 31 which may be moved axially over external threads formed on the lower adapter 12. A lock nut 32 may be employed to fix the position of the adjusting nut 31 in a conventional manner.

It will be understood that advancing the adjusting nut 31 axially toward the threaded lower end of the body 15 increases the compression of the spring 14 to thus increase the downwardly directed bias on the lower adapter 12. The total axially directed forces induced by the bellows 11 and spring 14 are also conveyed to the valve stem 13 which is threadedly engaged to the lower end of the lower adapter 12. A guide baffle 37 directs the axial movement of the valve stem 13 to maintain the contoured closure surfaces of the valve stem in a substantially concentric relationship with a valve seat 18*a* and central bore 18*b* extending axially through the valve head 18.

The check body 20 houses a check valve closure member 38 which is biased axially upwardly under the influence of a coil spring 39 into sealing engagement with a check disc 40. Coaxial alignment between the closure member 38 and the seat in the check disc 40 is maintained by means of a check baffle 41. As will hereinafter be more fully explained, the closure member 38 acts to prevent a reverse flow of fluid from the tubing T into the casing C when the tubing pressure exceeds the casing pressure.

With the valve $V_{10}$ in its open position, it will be understood that injection gas in the casing enters the valve through radial ports Sa extending through the mandrel pocket S. The valve $V_{10}$ is positioned in leakproof engagement within the mounting pocket S by means of suitable packing 42 carried on the external valve body. The gas entering the pocket S enters radial ports 18*c* formed in the valve head 18 where it then flows between the contoured valve closure surface formed at the lower end of the valve stem 13 and the valve seat 18*a* formed on the valve head 18 through the central head bore 18*b* past the check disc 40 and check baffle 41 in the open check valve where it enters the check body 20 and flows from the valve into the production tubing through bores 19*a* formed in the nose 19. Gas leaving the bores 19*a* formed in the nose of the valve flows into the tubing through a suitable bore Sb extending from the side pocket mounting S.

OPERATION OF THE VARIABLE ORIFICE VALVE

The valve $V_{10}$ of the present invention may be secured to an external side mounting lug (not shown) in a non-retrievable gas lift installation as the tubing string T is being lowered into the well, or if desirable, may be retrievably positioned as illustrated in FIG. 2 within the internal mandrel pocket S after the tubing T is in place in accordance with standard wireline practice. The well is then unloaded as previously described until the annulus A′ is free of fluids in the area above the valve $V_{10}$. The pressure of the injection gas which enters the radial ports 18*c* of the valve body, acts against the bellows area less the port area to move the lower adapter 12 axially upwardly through the surrounding upper housing body 15. An additional upward force is imposed on the adapter by the effect of the tubing pressure acting against the valve stem 13. The upward axial movement of the valve stem 13 is resisted by the force induced by the charge in the bellows area A and by the axially directed force exerted by the compressed spring 14. The amount of casing pressure required to move the lower adapter 12 axially upwardly is thus substantially determined by the amount of charge in the bellows area A and the compressive force exerted by the spring 14. Of course, the upward axial movement of adapter 12, and consequently stem 13, is limited by the engagement of the adapter 12 with bellows stop 23.

When the casing pressure is sufficiently high, the valve stem 13 is forced away from the seat 18*a* to permit the gas to flow through the head bore 18*b*. The pressure of the injection gas in the bore 18*b* forces the check valve closure member 38 downwardly to overcome the biasing force of the spring 39 which thereby frees the opening in the check disc 40 to permit the injection gas to flow into the tubing mandrel. Continued increase in the casing pressure moves the valve stem 13 even further away from the valve seat 18*a* to increase the effective orifice area through which the injection gas may enter the tubing. As stated heretofore, the movement of valve stem 13 away from the valve seat 18*a* is limited by the engagement of the upper end of adapter 12 with bellows stop 23.

The valve design causes the valve to throttle, i.e., remain open between different values of casing pressure with the valve stem moving axially within the throttling range to different positions producing variations in the effective orifice size. Thus, the valve includes a throttling range over which the effective orifice area of the gas injection passageway may be varied with corresponding variations in the rate of gas injection through the valve.

Figure 3:
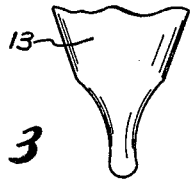
FIG. 3 is a detailed view illustrating the contour of the valve stem closure member in the valve of FIG. 2.
Figure 4:
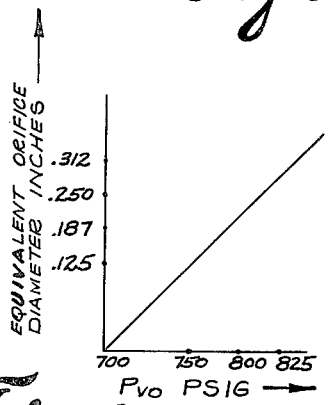
FIG. 4 is a graph illustrating the linear relationship between injection gas pressure opposite the operating valve and equivalent orifice diameter.

As may best be seen by joint reference to FIGS. 3 and 4, the closure surface formed at the lower end of the valve stem 13 is contoured to produce a linear relationship between the injection gas pressure and the effective orifice opening. Thus, as may be shown by reference to FIG. 4, as the casing or injection gas pressure increases, the effective orifice size of the valve increases at a linear rate. It should be noted that the contour illustrated in FIG. 3 of the drawings is a presently preferred form which produces the desired linear relationship between injection gas pressure and effective orifice size. Variation in the specific contour employed in the closing surface will produce a corresponding variation in the relationship between injection gas pressure and effective orifice size. It will therefore be understood that a given configuration may be employed to produce any desired relationship, linear or non-linear, between injection gas pressure and the valve's effective orifice size.

Figure 5:
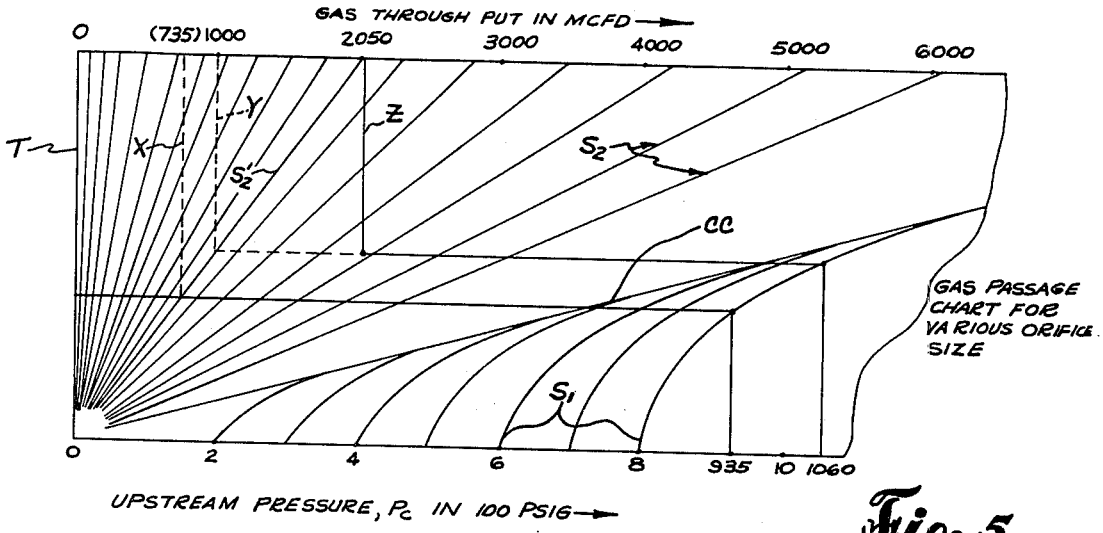
FIG. 5 is a gas passage chart for various orifice sizes illustrating the improved regulation range of the variable orifice gas lift valve of the present invention.

One of the advantages in the ability of the valve of the present invention to vary its orifice size over a throttling range may be readily perceived by reference to FIG. 5. FIG. 5 is a composite chart illustrating injection gas pressure ($P_c$) along the lower axis (upstream pressure) and gas throughput along the upper axis. The group of curves $S_1$ formed on the chart below a critical flow curve CC represent standard curves for the indicated pressure values. The curves $S_2$ above the critical flow curve represent different valve orifice sizes. Lines X and Y on the graph illustrate valve performance under the following given conditions:

1. Valve orifice is 14/64ths inches.
2. Tubing pressure is 800 psig.
3. The maximum casing gas pressure $P_c$ is 1060 psig.
4. The minimum casing pressure is 935 psig.

Line X illustrates the gas throughput for a 14/64-inch fixed orifice operating valve indicated by curve $S_2'$ wherein the casing pressure is 935 psig, and the tubing pressure is 800 psig. The gas throughput which is read at the top of the chart is seen to be approximately 735 million cubic feet per day (mcfd). Using the same valve but operating at an increased setting of casing pressure up to 1060 psig and maintaining the tubing pressure at 800 psig, it is seen that the gas throughput represented by the intersection with line Y is approximately 1,000 mcfd. The regulation range for the valve represented by the lines X and Y is therefore 1000 mcfd minus 735 mcfd which equals 265 mcfd.

By contrast, when using the variable orifice valve of the present invention with a 5/16th-inch orifice (bore 18*b*) and operating at the same values of maximum and minimum injected gas pressure and the same tubing pressure, the regulation range represented by the spread between the lines T and Z (2050 mcfd - 0 mcfd) is 2050 mcfd. With both valves, the following values were employed:

Gas gravity equals 0.65 (air equals 1.0);
Temperature equals 60° F.;
Atmospheric pressure equals 14.65 psi;
Gravity minus temperature correction;
Correction factor equal $0.0544 \times \sqrt{GT}$;
G equals gas gravity, T equals temperatures, ° *R*.

It will be readily appreciated from the results illustrated in FIG. 5 that the variable orifice gas lift valve of the present invention significantly increases the regulation range of a specific gas lift installation. Moreover, as will also be readily appreciated, the linear relationship between injection gas pressure and effective orifice size ensures that the response of the entire regulation range is linearly related to variations in injection gas pressure.

Figure 6:
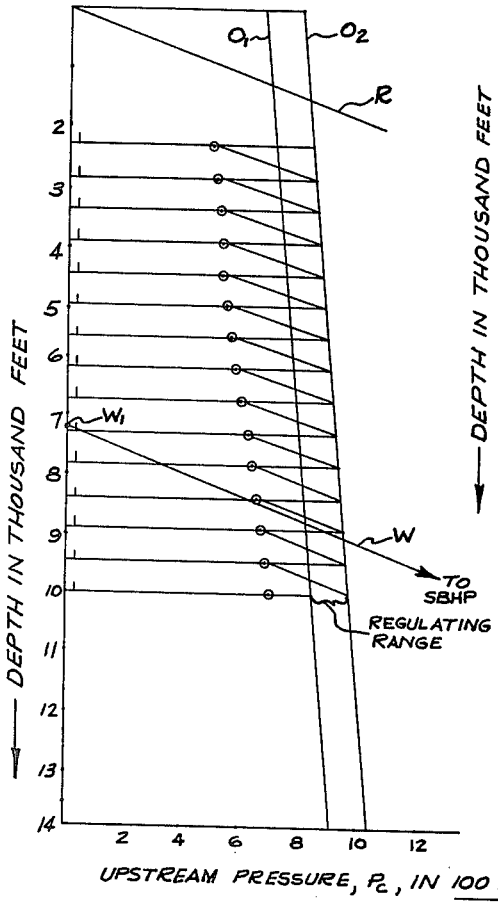
FIG. 6 is a graph of well depth versus injection gas pressure illustrating features of the variable orifice valve of the present invention with fluid operated valves as unloading valves.

FIG. 6 of the drawings illustrates the relationship between injection gas pressure and well depth in a system employing a variable orifice valve of the present invention as the operating valve at the bottom of a series of vertically spaced fluid operated unloading valves. The graph of FIG. 6 represents a well having the conditions specified therein employing the operating valve of the present invention with a throttling range of 125 psig and the load rate of the spring and bellows in series having a resultant load rate equal to 125 psig per 0.25 inch of valve stem travel. In the graph of FIG. 6, the line R represents the static gradient of load fluid ($G_{SL}$ = 0.465 psi per foot); the curves $0_1$ and $0_2$ represent the operating casing pressures; the curve W represents the static gradient of well fluid ($G_{SW}$ = 0.446 psi per foot) and extends to a point (not shown) representing the static bottomhole pressure (SBHP = 1400 psig at 10,300'). The point $W_1$ represents the static fluid level. The range between the curves $0_1$ and $0_2$ corresponds to the regulating range of the valve.

The graph illustrates the 125 psig regulation range between $0_1$ and $0_2$ where casing pressure $P_c$ can be altered to produce changes in the rate of gas being injected into the tubing. The graph is based on conditions where the maximum available gas pressure at the well head is approximately 800 psig. The resultant injection gas pressure at the operating valve, 10,000 feet below the well head, is 890 psig.

With a valve $V_{10}$ designed to have a 125 psig throttling range, the injection gas pressure $P_1$ required to move the valve to full open condition is 125 psig greater than the minimum pressure valve $P_2$ required to prevent the valve from closing. The valve will, of course, remain open for any pressure value greater than $P_1$ and will close with any injection gas pressure value below $P_2$. Over the range of pressure between $P_1$ to $P_2$, the orifice size of the valve is variable. For pressures in excess of $P_2$, the orifice size remains fixed as with conventional, fixed orifice valves. The important control area is therefore in the pressure range between $P_1$ and $P_2$ since orifice size varies with pressure to alter the rate of gas injection into the tubing over this range.

Figure 7:
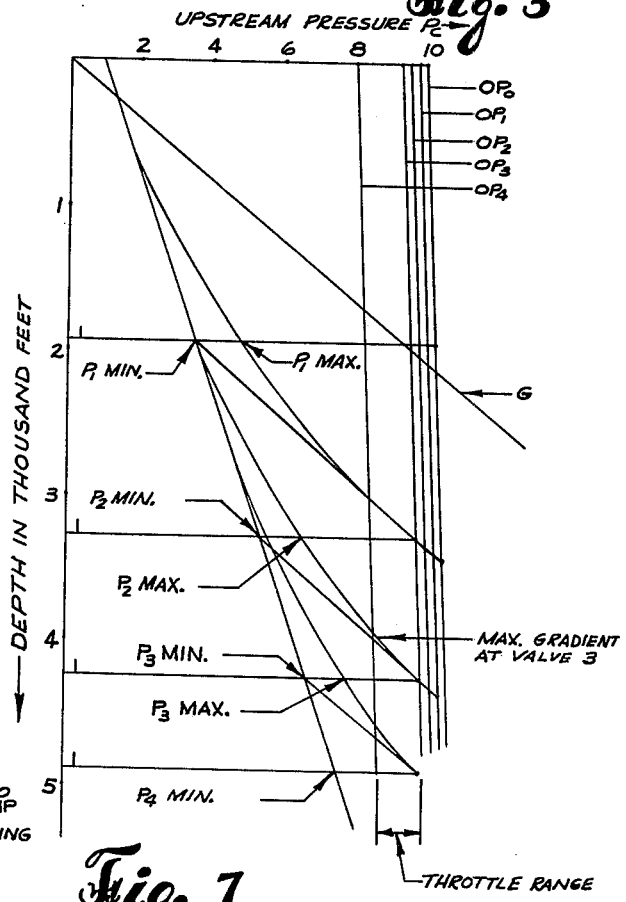
FIG. 7 is a graph of well depth versus injection gas pressure illustrating characteristics of a system employing the variable orifice gas lift valve of the present invention with casing pressure sensitive valves employed as the unloading valves.

FIG. 7 of the drawings illustrates a graph depicting the variable orifice valve of the present invention in a system employing casing pressure operated unloading valves. The curves $OP_0$, $OP_1$, $OP_2$, $OP_3$ and $OP_4$ represent the operating casing pressure; the curve G represents the relationship between pressure and depth for the fluid having a zero gas to liquid ratio (OGLR). The following table represents the injection gas to liquid ratios (IGLR) required to attain the minimum gradient:

GAS LIFT METHOD AND APPARATUS

| DEPTH (ft) | IGLR (cfb) |
|---|---|
| 2000 | 600 |
| 3000 | 800 |
| 4000 | 1000 |
| 5000 | 1400 |
| 6000 | 1400 |
| 6300 | 2000 |

The curves $P_1$ through $P_4$ represent tubing pressure for vertically spaced valves with the designations "min" and "max" representing the minimum and maximum fluid pressure in the tubing for the respective valves.

The 125 psig throttling range in the system depicted in FIG. 7 is from 800 psig to 925 psig. As with the preferred system employing fluid operated unloading valves, the system in FIG. 7 may be regulated by varying casing pressure at the well head to effect a remote control over the rate of gas injected into the tubing.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A continuous flow gas lift system for use in a well having tubing through which well fluids are elevated and casing into which injection gas is supplied, comprising: fluid operated unloading valve means on said tubing for conveying fluids from said casing to said tubing during initiation of flow from the well, said unloading valve means opening in response to a predetermined level of pressure in said tubing and closing when said pressure declines to another predetermined level; and casing pressure controlled operating valve means on said tubing below said unloading valve means enabling injection of gas supplied to said casing into a column of fluids contained in said tubing, said operating valve means including a valve body having a flow path extending between inlet means in communication with said casing and outlet means in communication with said tubing, and closure means including seat means and movable valve stem means arranged whereby said flow path is closed by moving said valve stem means into sealing contact with said seat means, said valve stem means having a countoured surface thereon cooperating with said seat means whereby movement of said valve stem means alters the effective size of said flow path in a linear relationship with the pressure of gas at said inlet means for regulating the rate of gas flow through said flow path.

2. The system of claim 1 wherein said operating valve means further includes control means connected with said valve stem means and comprising a variable size, pressure charged chamber exposed to and responsive to the pressure of gas at said inlet means.

3. The system of claim 2 wherein said chamber includes a bellows, and said control means further comprises spring means cooperating with said bellows, and adjustment means for altering the biasing force exerted by said spring means.

* * * * *